US008289304B2

(12) United States Patent
Chiou

(10) Patent No.: US 8,289,304 B2
(45) Date of Patent: Oct. 16, 2012

(54) DISPLAY DEVICE AND METHOD FOR ADJUSTING THE LUMINANCE THEREOF

(75) Inventor: Junc Chiou, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 379 days.

(21) Appl. No.: 12/656,034

(22) Filed: Jan. 14, 2010

(65) Prior Publication Data

US 2010/0214275 A1 Aug. 26, 2010

(30) Foreign Application Priority Data

Feb. 23, 2009 (TW) ..... 98105707 A

(51) Int. Cl.
*G09G 5/00* (2006.01)

(52) U.S. Cl. ..... 345/207; 340/815.55

(58) Field of Classification Search ..... 345/38, 345/50–54, 60–64, 87–104, 207; 340/815.4; 313/484, 498
See application file for complete search history.

(56) References Cited

U.S. PATENT DOCUMENTS

2005/0057484 A1* 3/2005 Diefenbaugh et al. ..... 345/102
2007/0070002 A1* 3/2007 Fujita et al. ..... 345/87
2007/0146302 A1* 6/2007 Liu et al. ..... 345/102
2007/0247414 A1* 10/2007 Roberts ..... 345/102
2007/0268241 A1* 11/2007 Nitta et al. ..... 345/102
2008/0001910 A1* 1/2008 Lim ..... 345/102
2009/0237423 A1* 9/2009 Shih et al. ..... 345/690
2010/0007599 A1* 1/2010 Kerofsky ..... 345/102
2010/0309107 A1* 12/2010 Muroi et al. ..... 345/88
2011/0050738 A1* 3/2011 Fujioka et al. ..... 345/690

FOREIGN PATENT DOCUMENTS

CN 101021625 A 8/2007

OTHER PUBLICATIONS

The Office Action of corresponding CN Application No. 200910009153.1.

* cited by examiner

*Primary Examiner* — Amare Mengistu
*Assistant Examiner* — Vinh Lam
(74) *Attorney, Agent, or Firm* — Bacon & Thomas, PLLC

(57) ABSTRACT

A display device for receiving and displaying an image signal is disclosed. The display device comprises a display screen, a light sensor, a light information determining unit, an image analysis unit, a luminance determining unit, and a control unit. The light sensor is installed near the display screen for detecting an ambient luminance level. The light information determining unit is utilized for determining a first luminance adjusting value according to the ambient luminance. The image analysis unit is utilized for analyzing the image signal to obtain a color level value. The luminance determining unit is utilized for calculating a second luminance adjusting value according to the color level value, and for determining a final luminance adjusting value according to the first luminance adjusting value and the second luminance adjusting value. The control unit is utilized for adjusting the luminance of the display screen according to the final luminance adjusting value.

12 Claims, 2 Drawing Sheets

DISPLAY DEVICE AND METHOD FOR ADJUSTING THE LUMINANCE THEREOF

BACKGROUND OF THE INVENTION

1. Field of the Invention

The present invention relates to a display device and method for adjusting the luminance thereof, and more particularly, to a display device and method for automatically adjusting luminance according the ambient luminance and the luminance of the received image signal.

2. Description of the Related Art

A display device is used for displaying images. Generally, the display device can be electrically connected to a computer for displaying operating interfaces, or electrically connected to an antenna or a cable for receiving TV signals or other kinds of image signals. The user can adjust the characteristics (such as luminance, contrast, etc.) of the display device with the corresponding interface based on the personal requirements or the place where the display device is disposed.

For a liquid crystal display device, in the prior art, there are related designs allowing the luminance of the display screen to be adjusted according to the detected ambient luminance. But it is difficult to achieve a balance between image quality and power consumption. When the design is focused more on the image quality, there is higher power consumption. Oppositely, when the design is focused more on decreasing the power consumption, the image quality is decreased. For example, when the liquid crystal display device displays dynamic video images, in order to decrease the power consumption, the luminance of the high luminance image or the low luminance image will be decreased in a low luminance place. As a result, the low luminance image will be too dark to be recognized.

SUMMARY OF THE INVENTION

It is a main objective of the present invention to provide a display device capable of adjusting the luminance according to the ambient luminance and the luminance of the received image signal.

To achieve the abovementioned objective, a display device of the present invention for receiving and displaying an image signal is disclosed. The display device of the present invention comprises a display screen, a light sensor, a light information determining unit, an image analysis unit, a luminance determining unit, and a control unit. The light sensor is installed near the display screen for detecting the ambient luminance. The light information determining unit is utilized for calculating a first luminance adjusting value according to the ambient luminance. The image analysis unit is utilized for analyzing the image signal to obtain a color level value. The luminance determining unit is utilized for calculating a second luminance adjusting value according to the color level value, and determining a final luminance adjusting value according to the first luminance adjusting value and the second luminance adjusting value. The control unit is utilized for adjusting the luminance of the display screen according to the final luminance adjusting value. Accordingly, the display device of the present invention is capable not only of determining whether the ambient luminance is sufficient, but also of adjusting correspondingly the screen luminance according to the luminance of the received image signal. Furthermore, the display device of the present invention can reduce the power consumption of the screen or achieve a better display effect with different display modes.

The method of adjusting the luminance of a display device of the present invention comprises the following steps: detecting an ambient luminance to calculate a first luminance adjusting value; analyzing an image signal to obtain a color level value; calculating a second luminance adjusting value according to the color level value; determining a final luminance adjusting value according to the first luminance adjusting value and the second luminance adjusting value; and adjusting the luminance of the display screen according to the final luminance adjusting value.

Other objects, advantages, and novel features of the present invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
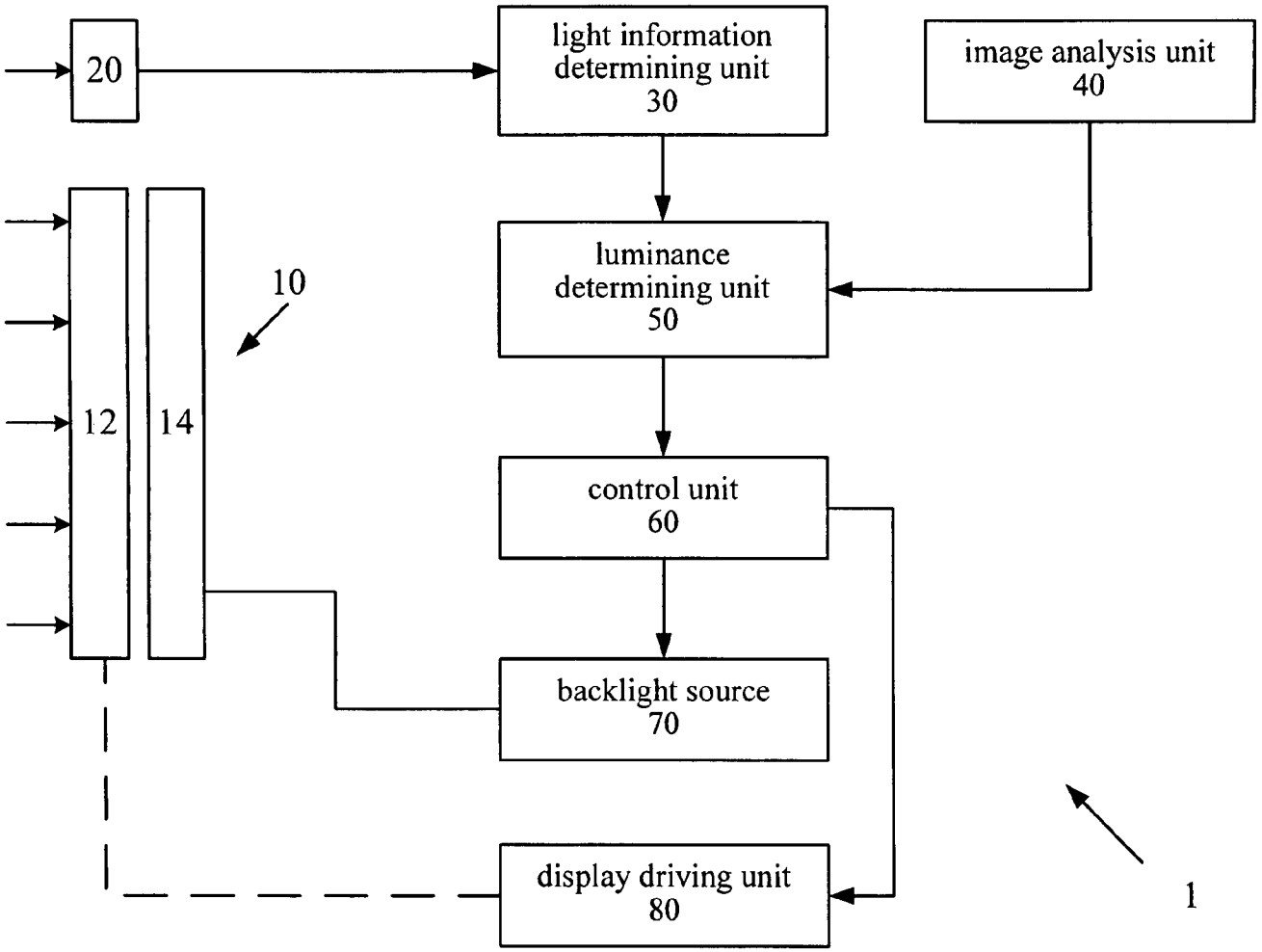
FIG. 1 is a functional block diagram of a display device of the present invention.

Please refer to FIG. 1. FIG. 1 is a functional block diagram of a display device 1 of the present invention. The display device 1 of the present invention can receive and display image signals. As shown in FIG. 1, the display device 1 comprises a display screen 10, a light sensor 20, a light information determining unit 30, an image analysis unit 40, a luminance determining unit 50, and a control unit 60. The display screen 10 comprises a liquid crystal panel 12 and a backlight module 14. The light sensor 20 can be a light meter or other type of light sensing unit installed near the display screen 10. The light sensor 20 is utilized for detecting the ambient light projected on the display screen to obtain an ambient luminance. The light information determining unit 30 is electrically connected to the light sensor 20 for receiving the detected ambient luminance and calculating accordingly to obtain a first luminance adjusting value. The image analysis unit 40 is utilized for analyzing the color level status of the received image signal to obtain a color level value. The luminance determining unit 50 can determine a second luminance adjusting value according to the color level value.

The luminance determining unit 50 is electrically connected to the light information determining unit 30 and the image analysis unit 40 for receiving the first luminance adjusting value corresponding to the ambient luminance and the second luminance adjusting value corresponding to the image luminance in order to obtain a final luminance adjusting value via calculation. The control unit 60 is electrically connected to the luminance determining unit 50, a backlight source 70, and a display driving unit 80. When the control unit 60 receives the final luminance adjusting value, the control unit 60 can adjust the luminance of the backlight module 14 by controlling the input power from the backlight source 70 to the backlight module 14 according to the final luminance adjusting value; the control unit 60 can also adjust the luminance of the display screen 10 by controlling the display driving unit 80 to drive the LCD screen 12 according to the final luminance adjusting value.

First, the calculation of the first luminance adjusting value corresponding to the ambient luminance is discussed. The display device 1 of the present invention is capable of calculating the first luminance adjusting value with the following equation:

$$L_1=(B_{max}-B_{min})*(Le-Le_{min})/(Le_{max}-Le_{min})+B_{min} \quad (1)$$

where $L_1$ is the first luminance adjusting value, Le is the ambient luminance detected by the light sensor 20, $Le_{max}$ is a detectable maximum ambient luminance detected by the light sensor 20, $Le_{min}$ is a detectable minimum ambient luminance detected by the light sensor 20, $B_{max}$ is an adjustable maximum luminance limit corresponding to the ambient luminance, and $B_{min}$ is an adjustable minimum luminance limit corresponding to the ambient luminance. The maximum luminance limit $B_{max}$ and the minimum luminance limit $B_{min}$ can be adjusted according to different settings of the display device 1. The ambient luminance detected by the light sensor 20 can be quantified to a quantitative ratio value via the light information determining unit 30. When the display device 1 is in a place without any ambient light, the ambient luminance detected by the light sensor 20 is the minimum ambient luminance $Le_{min}$; when the display device 1 is in a place with sunlight or another strong light source, the ambient luminance detected by the light sensor 20 is the maximum ambient luminance $Le_{max}$. Therefore, the maximum ambient luminance $Le_{max}$ or the minimum ambient luminance $Le_{min}$ can be a quantitative standard for determining the ambient luminance detected by the light sensor 20.

For example, assuming the luminance adjustable range of the display device 1 is set from 40 to 80 according to the ambient luminance (the luminance adjustable range of a general display device is set from 0 to 100), the maximum luminance limit $B_{max}$ is equal to 80, and the minimum luminance limit $B_{min}$ is equal to 40. Assuming also that the maximum ambient luminance $Le_{max}$ is equal to 20, and the minimum ambient luminance $Le_{min}$ is equal to 0. With the above assumptions, when the ambient luminance Le detected by the light sensor 20 is equal to 20, the first luminance adjusting value $L_1$ can be obtained as 80 with equation (1). In other words, when the ambient luminance is at the maximum value, the display device 1 will adjust the luminance of the display screen 10 to the maximum luminance limit $B_{max}$. In contrast, when the ambient luminance Le detected by the light sensor 20 is equal to 0, the first luminance adjusting value $L_1$ can be obtained as 40 with equation (1). In other words, when the ambient luminance is at the minimum value, the display device 1 will adjust the luminance of the display screen 10 to the minimum luminance limit $B_{min}$. Therefore, the display device 1 of the present invention can adjust the luminance of the display screen 10 with the first luminance adjusting value $L_1$ corresponding to different values of ambient luminance.

Next, the calculation of the second luminance adjusting value corresponding to the image luminance is discussed. The display device 1 of the present invention can set a standard color level value as a reference for determining the luminance of the image signal in order to define the image signal as a high luminance image or a low luminance image. The standard color level value is between 0 and 255. The luminance determining unit 50 receives the color level value of the image signal from the image analysis unit 40 and compares the received color level value with the standard color level value. Then the second luminance adjusting value is obtained with a corresponding equation, wherein when the color level value is larger or equal to the standard color level value, the display device 1 of the present invention is capable of calculating the second luminance adjusting value with the following equation:

$$L_2=B*(Lv-Lv_{min})/Lv_{max} \quad (2)$$

where $L_2$ is the second luminance adjusting value, Lv is the color level value, $Lv_{max}$ is an obtainable maximum color level value, $Lv_{min}$ is an obtainable minimum color level value, and B is a luminance adjusting range corresponding to the image analysis unit 40. In this status, the standard color level value is set to the obtainable minimum color level value $Lv_{min}$.

For example, assuming the standard color level value of the display device 1 is 100; the luminance adjusting range B corresponding to the image analysis unit 40 is 20 (from 0 to 20); and the obtainable maximum color level value $Lv_{max}$ is 255; then the obtainable minimum color level value $Lv_{min}$ will be equal to 100. With the above assumptions, then when the image signal has the highest luminance, the color level value Lv obtained by the image analysis unit 40 is equal to 255, and the luminance determining unit 50 can obtain the second luminance adjusting value $L_2$ as 12 with equation (2). In other words, when the image signal has the highest luminance, the display device 1 can add extra luminance to the display screen 10 up to a value of 12. In contrast, when the color level value Lv obtained by the image analysis unit 40 is equal to 100, then the luminance determining unit 50 can obtain the second luminance adjusting value $L_2$ as 0 with equation (2). In other words, the display device 1 will not adjust the luminance of the display screen 10 in such a status. Therefore, when the color level value Lv is larger than the standard color level value, the display device 1 of the present invention will increase the corresponding second luminance adjusting value $L_2$ with increases in the color level value Lv.

On the other hand, when the color level value Lv obtained by the luminance determining unit 50 is smaller than the standard color level value, the display device 1 of the present invention is capable of calculating the second luminance adjusting value with the following equation:

$$L_2=B*[1-(Lv-Lv_{min})/Lv_{max}] \quad (3)$$

where $L_2$ is the second luminance adjusting value, Lv is the color level value, $Lv_{max}$ is an obtainable maximum color level value, $Lv_{min}$ is an obtainable minimum color level value, and B is a luminance adjusting range corresponding to the image analysis unit 40. In this status, the standard color level value is set to the maximum color level value $Lv_{max}$.

For example, assuming that the standard color level value of the display device 1 is 100, then the luminance adjusting range B corresponding to the image analysis unit 40 is 20 (from 0 to 20). Then the obtainable maximum color level value $Lv_{max}$ is 100, and the obtainable minimum color level value $Lv_{min}$ will be equal to 0. With the above assumptions, when the image signal has the lowest luminance, the color level value Lv obtained by the image analysis unit 40 is equal to 0; then the luminance determining unit 50 can obtain the second luminance adjusting value $L_2$ as 20 with equation (3). In other words, when the image signal has the lowest luminance, the display device 1 can add extra luminance to the display screen 10 up to a value of 20. In contrast, when the color level value Lv obtained by the image analysis unit 40 is equal to 100, then the luminance determining unit 50 can obtain the second luminance adjusting value $L_2$ as 0 with equation (3), which has the same result as equation (2). In other words, the display device 1 will not adjust the luminance of the display screen 10 in such a status. Therefore, when the color level value Lv is smaller than the standard color level value, the display device 1 of the present invention will decrease the corresponding second luminance adjusting value $L_2$ with increases in the color level value Lv.

After receiving the first luminance adjusting value $L_1$ corresponding to the ambient luminance and the second luminance adjusting value $L_2$ corresponding to the image luminance, the luminance determining unit 50 can obtain the final luminance adjusting value via calculation. The display device 1 of the present invention is capable of calculating the final luminance adjusting value with the following equation:

$$L=L_1 \pm L_2+S \quad (4)$$

where L is the final luminance adjusting value, $L_1$ is the first luminance adjusting value, $L_2$ is the second luminance adjusting value, and S is a compensation value. The plus or minus sign ± in equation (4) is determined according to different operation modes. The compensation value S is set according to different situations.

The display device 1 of the present invention can activate a power saving mode or a viewing mode according to the requirement. When the power saving mode is activated, the luminance of the display screen 10 can be reduced in order to decrease the power consumption. Therefore, the luminance determining unit 50 calculates the reduction of the final luminance adjusting value L by subtracting the second luminance adjusting value $L_2$ from the first luminance adjusting value $L_1$ in equation (4). The power saving mode mostly is activated when the received image signal is a still image. For example, when using Microsoft Office Word or other similar software, the user needs only to recognize the letters on the screen, and it is not necessary to set the display screen 10 to high luminance. Therefore, in the power saving mode, in order to reduce the luminance of the display screen 10 to decrease the power consumption, the second luminance adjusting value $L_2$ is subtracted from the first luminance adjusting value $L_1$ in equation (4).

In addition, when the viewing mode is activated, the luminance determining unit 50 can determine whether to add or subtract the second luminance adjusting value $L_2$ to or from the first luminance adjusting value $L_1$ in equation (4) according to the image color level value in order to increase or decrease the final luminance adjusting value L. The viewing mode mostly is activated for dynamic images. For example, when a video or a video game is displayed, the luminance of the image signal may be changed at any time. Therefore, when the luminance of the image signal is too high, the luminance of the display screen 10 is decreased by subtracting the second luminance adjusting value $L_2$ from the first luminance adjusting value $L_1$ in equation (4).

In contrast, when the luminance of the image signal is too low, the luminance of the display screen 10 is increased by adding the second luminance adjusting value $L_2$ to the first luminance adjusting value $L_1$ in equation (4).

With the above design, the display device 1 of the present invention is capable of adjusting the luminance of the display screen 10 according to the ambient luminance level and the luminance of the received image signal. The display device 1 of the present invention can activate different modes to decrease the power consumption or to provide better image quality.

Figure 2:
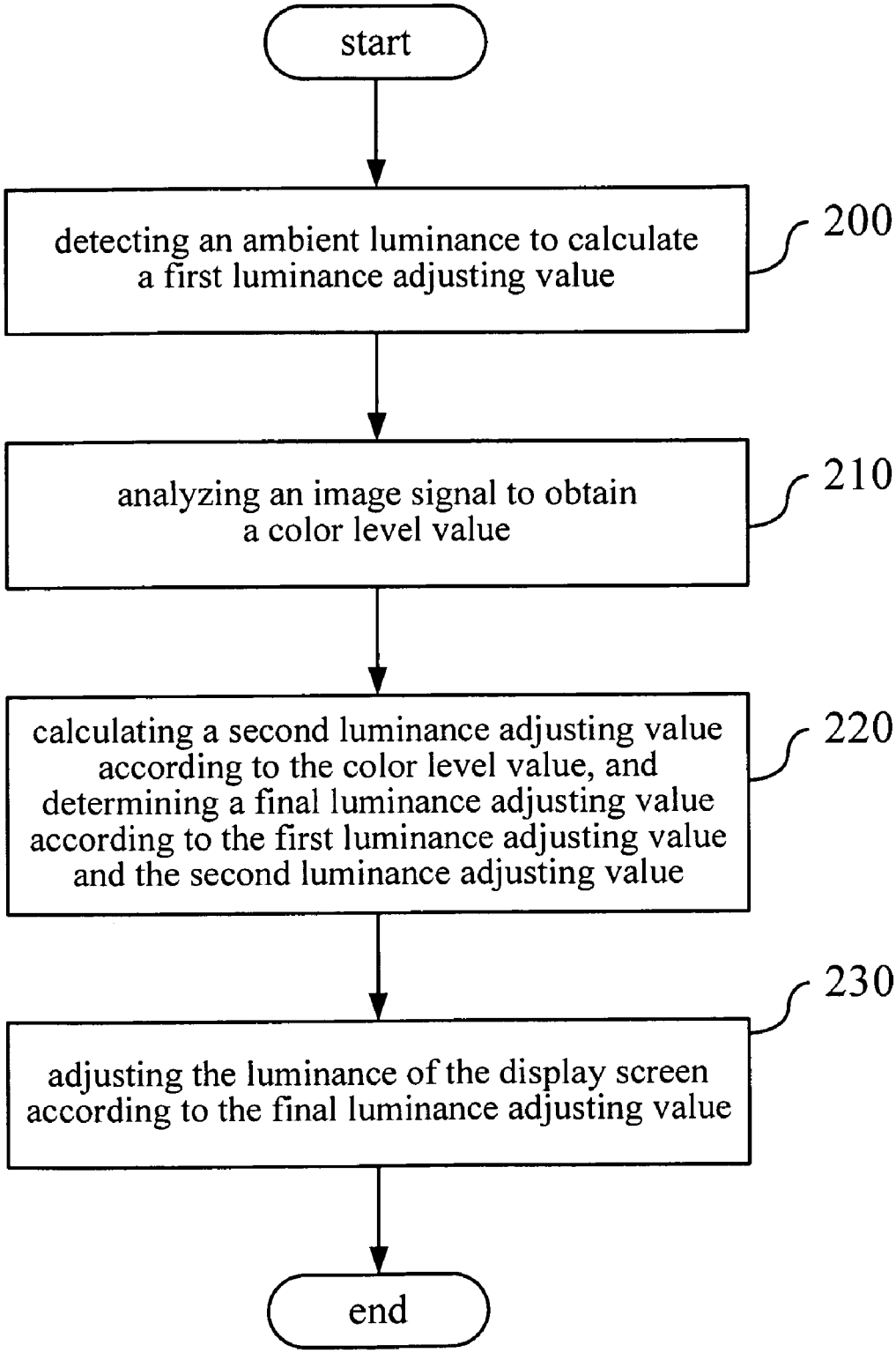
FIG. 2 is a flow chart of a luminance adjusting method of the display device of the present invention.

Please refer to FIG. 2. FIG. 2 is a flow chart of a luminance adjusting method of the display device 1 of the present invention. The display device 1 in FIG. 1 is only an example for illustrating the luminance adjusting method. The luminance adjusting method of the present invention can also be applied to other kinds of similar display devices. As shown in FIG. 2, the luminance adjusting method of the present invention comprises several steps, from 200 to 230. Each step of the luminance adjusting method is explained below.

Step 200: detecting an ambient luminance to calculate a first luminance adjusting value. As shown in FIG. 1, the display device 1 of the present invention comprises the light sensor 20 and the light information determining unit 30. In order to detect the ambient luminance around the display device 1, the light sensor 20 is installed near the display screen 10 for obtaining the ambient luminance by detecting the ambient light projected on the display screen 10. The detected ambient luminance can be substituted into the equation (1) for calculation of the first luminance adjusting value.

Step 210: analyzing the image signal to obtain a color level value. The display device 1 comprises the image analysis unit 40 for analyzing the received image signal of the display device 1 to obtain the color level value. The color level value can be further calculated by the image analysis unit 40.

Step 220: The luminance determining unit 50 obtains the second luminance adjusting value via the color level value, wherein the second luminance adjusting value can be obtained by either equation (2) or equation (3), depending on the comparison with the color level value and the set standard color level value of the display device 1. Then a final luminance adjusting value can be determined according to the first luminance adjusting value and the second luminance adjusting value. As shown in FIG. 1, the display device 1 comprises the luminance determining unit 50. The luminance determining unit 50 can obtain the final luminance adjusting value by substituting the first luminance adjusting value and the second luminance adjusting value into equation (4), wherein the luminance determining unit 50 obtains the final luminance adjusting value L by adding/subtracting the second luminance adjusting value $L_2$ to/from the first luminance adjusting value $L_1$ according to different modes.

Step 230: adjusting the luminance of the display screen according to the final luminance adjusting value. The display device 1 further comprises the control unit 60. According to the final luminance adjusting value, the control unit 60 can control the input power from the backlight source 70 to the backlight module 14, and the control unit 60 can also control the display driving unit 80 to drive the LCD screen 12. As a result, the display device 1 can adjust the luminance of the display screen 10 in different situations.

Although the present invention has been explained in relation to its preferred embodiments, it is to be understood that many other possible modifications and variations can be made without departing from the spirit and scope of the invention as hereinafter claimed.

What is claimed is:

1. A display device for receiving and displaying an image signal, the display device comprising:

a display screen;

a light sensor installed near the display screen for detecting an ambient luminance;

a light information determining unit for calculating a first luminance adjusting value according to the ambient luminance;

an image analysis unit for analyzing the image signal to obtain a color level value;

a luminance determining unit for calculating a second luminance adjusting value according to the color level value, and determining a final luminance adjusting value according to the first luminance adjusting value and the second luminance adjusting value; and a control unit for adjusting the luminance of the display screen according to the final luminance adjusting value;

wherein the final luminance adjusting value is obtained with the following equation:

$$L=L_1 \pm L_2+S,$$

where L is the final luminance adjusting value, $L_1$ is the first luminance adjusting value, $L_2$ is the second luminance adjusting value, S is a compensation value; and wherein the first luminance adjusting value $L_1$ is obtained with the following equation:

$$L_1=(B_{max}-B_{min})*(Le-Le_{min})/(Le_{max}-Le_{min})+B_{min},$$

where Le is the ambient luminance, $Le_{max}$ is a detectable maximum ambient luminance, $Le_{min}$ is a detectable minimum ambient luminance level, $B_{max}$ is an adjustable maximum luminance limit, and $B_{min}$ is an adjustable minimum luminance limit.

2. The display device as claimed in claim 1, wherein when a power saving mode is activated, the luminance determining unit reduces the final luminance adjusting value by subtracting the second luminance adjusting value from the first luminance adjusting value.

3. The display device as claimed in claim 1, wherein when a viewing mode is activated, the luminance determining unit adjusts the final luminance adjusting value by adding the second luminance adjusting value to the first luminance adjusting value, or by subtracting the second luminance adjusting value from the first luminance adjusting value, according to the color level value.

4. The display device as claimed in claim 1, wherein a standard color level value can be set between 0 and 255.

5. The display device as claimed in claim 4, wherein when the color level value is larger or equal to the standard color level value, the standard color level value is set to the obtainable minimum color level value, and the second luminance adjusting value is obtained with the following equation:

$$L_2=B*(Lv-Lv_{min})/Lv_{max}$$

where $L_2$ is the second luminance adjusting value, Lv is the color level value, $Lv_{max}$ is an obtainable maximum color level value, $Lv_{min}$ is an obtainable minimum color level value, and B is a luminance adjusting range corresponding to the image analysis unit.

6. The display device as claimed in claim 4, wherein when the color level value is smaller than the standard color level value, the standard color level value is set to the obtainable maximum color level value, and the second luminance adjusting value is obtained with the following equation:

$$L_2=B*[1-(Lv-Lv_{min})/Lv_{max}]$$

where $L_2$ is the second luminance adjusting value, Lv is the color level value, $Lv_{max}$ is an obtainable maximum color level value, $Lv_{min}$ is an obtainable minimum color level value, and B is a luminance adjusting range corresponding to the image analysis unit.

7. A method for adjusting luminance of a display device, the display device being capable of receiving and displaying an image signal, the method comprising the following steps:

detecting an ambient luminance to calculate a first luminance adjusting value;

analyzing the image signal to obtain a color level value;

calculating a second luminance adjusting value according to the color level value;

determining a final luminance adjusting value according to the first luminance adjusting the luminance of the display screen according to the final luminance adjusting value;

wherein the final luminance adjusting value is obtained with the following equation:

$$L=L_1 \pm L_2+S,$$

where L is the final luminance adjusting value, $L_1$ is the first luminance adjusting value, $L_2$ is the second luminance adjusting value, S is a compensation value; and wherein the first luminance adjusting value $L_1$ is obtained with the following equation:

$$L_1=(B_{max}-B_{min})*(Le-Le_{min})/(Le_{max}-Le_{min})+B_{min},$$

where Le is the ambient luminance, $Le_{max}$ is a detectable maximum ambient luminance, $Le_{min}$ is a detectable minimum ambient luminance level, $B_{max}$ is an adjustable maximum luminance limit, and $B_{min}$ is an adjustable minimum luminance limit.

8. The method as claimed in claim 7, wherein when a power saving mode is activated, the final luminance adjusting value is reduced by subtracting the second luminance adjusting value from the first luminance adjusting value.

9. The method as claimed in claim 7, wherein when a viewing mode is activated, the final luminance adjusting value is adjusted by adding the second luminance adjusting value to the first luminance adjusting value, or by subtracting the second luminance adjusting value from the first luminance adjusting value according to the color level value.

10. The method as claimed in claim 7, wherein a standard color level value can be set between 0 and 255 for a judging standard of the color level value.

11. The method as claimed in claim 10, wherein when the color level value is larger or equal to the standard color level value, the standard color level value is set to the obtainable minimum color level value, and the second luminance adjusting value is obtained with the following equation:

$$L_2B*(Lv-Lv_{min})/Lv_{max}$$

where $L_2$ is the second luminance adjusting value, Lv is the color level value, $Lv_{max}$ is an obtainable maximum color level value, $Lv_{min}$ is an obtainable minimum color level value, and B is a luminance adjusting range corresponding to the image analysis unit.

12. The method as claimed in claim 10, wherein when the color level value is smaller than the standard color level value, the standard color level value is set to the obtainable maximum color level value, and the second luminance adjusting value is obtained with the following equation:

$$L_2=B*[1-(Lv-Lv_{min})/Lv_{max}]$$

where $L_2$ is the second luminance adjusting value, Lv is the color level value, $Lv_{max}$ is an obtainable maximum color level value, $Lv_{min}$ is an obtainable minimum color level value, and B is a luminance adjusting range corresponding to the image analysis unit.

* * * * *